343-754 SR
8/12/80 OR 4,217,590

United States Patent [19]
Wild et al.

[11] 4,217,590
[45] Aug. 12, 1980

[54] ELECTROMAGNETIC LENS FOR RF AERIALS

[75] Inventors: John P. Wild, Strathfield; Geoffrey T. Poulton, Telopea, both of Australia

[73] Assignee: Commonwealth Scientific and Industrial Research Organization, Campbell, Australia

[21] Appl. No.: 945,289

[22] Filed: Sep. 25, 1978

[30] Foreign Application Priority Data

Sep. 23, 1977 [AU] Australia ..... PD1800

[51] Int. Cl.[2] ..... H01Q 19/06; H01Q 15/24
[52] U.S. Cl. ..... 343/754; 343/909
[58] Field of Search ..... 343/754, 911 L, 911 R, 343/910, 909, 854, 853

[56] References Cited

U.S. PATENT DOCUMENTS 2,767,396 10/1956 Cutler ..... 343/909
3,245,081 4/1966 McFarland ..... 343/754
4,080,605 3/1978 Hilton ..... 343/754

*Primary Examiner*—David K. Moore
*Attorney, Agent, or Firm*—Sughrue, Rothwell, Mion, Zinn and Macpeak

[57] ABSTRACT

An electromagnetic lens for a commutated scanning beam antenna has a plurality of petal-shaped parallel plate segments, connected in series, with the first petal-shaped segment adapted to receiver power at its input edge through an array of input probes connected, in a commutative switching arrangement, to a radio frequency transmitter. The last petal-shaped segment of the lens is formed into a radiating aperture or is connected to a linear array of radiating elements. Various techniques for determining petal shapes and for connecting together the petals are discussed. Stacked and folded lenses are described.

17 Claims, 14 Drawing Figures

ELECTROMAGNETIC LENS FOR RF AERIALS

This invention concerns antenna structures for use in the generation of scanned radio beams. More particularly it concerns a new form of lens for a scanning beam antenna. It was designed originally as an alternative structure to the electromagnetic lens featured in the specification of U.S. patent application Ser. No. 753,383 filed on Dec. 22, 1976 (now U.S. Pat. No. 4,114,162).

The antenna described in the aforementioned U.S. Pat. No. 4,114,162 consists of several items, one of which is a quarter sphere, parallel plate, geodesic lens which, in use, connects an array of input elements (usually input probes) with a linear array of radiating elements (typically column radiators). That geodesic lens performs a Fourier transform of the signal applied to its input probes, which results in the production of a signal across the array of radiators which has a linear phase gradient when any one (or any unified group) of the input elements is (or are) excited. Commutative switching of the excitation elements results in a variation of the linear phase gradient across the linear array, with consequent scanning of the beam radiated by the array of radiators.

That antenna has a number of operational advantages over its predecessors, but when it is used to generate a narrow beam which scans through a large coverage angle (for example, a 1° beam scanning through ±40°), a large quarter sphere lens is required. Large antennas are not favoured for airport installations, and the size of the lens of the antenna limits its usefulness in high accuracy, wide coverage approach and landing guidance systems for aircraft.

The prime objective of the present invention is to provide a lens for a scanning beam antenna which enables this limitation to be overcome.

In achieving this objective, the present invention breaks the tradition, initiated by the antenna using the parallel plate version of the Luneberg Lens, described by R. C. Johnson in the Microwave Journal, volume 5, page 76, April 1962. That antenna used a single extensive parallel plate transmission line as an electromagnetic lens. In the place of the single structure lens, the present invention provides a plurality of individual lens elements, joined together by appropriate interconnection means. The interconnection means may be any one of a variety of arrangements. One such arrangement is the coupling of power out of one lens element and into the next lens element by output and input probes connected by coaxial cable. Other arrangements include the coupling of the lens elements with smoothly curved or specially shaped sections of parallel plate transmission line and coupling effected by appropriately shaped and located slots. Examples of these forms of interconnection will be described later in this specification.

In determining the nature of the individual lens elements which make up the equivalent of a quarter-sphere lens, two basic approaches have been adopted. The first approach is the dissection of the quarter-sphere electromagnetic lens, into a plurality of parallel plate sections or "petals", which are then separated and coupled together to reconstitute the original signal path through the lens. This approach can be extended to the substitution of equivalent (in terms of performance) lens "petals" which have a different physical construction from the "petals" of the segmented quarter-sphere geodesic lens.

Using this approach, the geodesic lens structure described in the specification of U.S. Pat. No. 4,114,162 may be reconstructed as a number of individual petal-shaped lens elements, interconnected so that the essential characteristics of the required wavefronts propagating through the lens are preserved. With this lens structure, each petal element corresponds to that part of the quarter sphere which is included between two great circle lines having a common polar axis (similar to the longitude lines of the earth's surface), such as lines AFC, AGC in FIG. 1, referred to later. If corresponding points on each edge of the petal are joined by straight lines, the surface formed by those straight lines is a cylindrical approximation to the petal surface and may be flattened without distortion of the wavefronts propagating through the parallel plates. Such flattened surfaces are examples of the equivalent lens petals referred to in the extension of this approach. "Half-petals" may be used as input and output elements of the lens so that the input and output probes in the flattened surface lie in straight lines.

With all such arrangements, it has been shown by computation that, provided reflectionless interconnection of lens petals can be achieved, the aberration introduced using a lens constructed of a number of lens petals is comparable to the aberration experienced with aerials incorporating the quarter-sphere geodesic lens.

The second approach is to determine an optimum combination of design parameters for a multi-element parallel plate "petal" lens to satisfy specific constraints. For example, input probes will generally not be equally spaced. Thus one such constraint might be the equispacing of signal input probes and/or output probes along straight lines (a) for ease of manufacture of the lens, (b) to achieve equal mutual couplings and impedances for each probe, (c) to achieve output probe spacings corresponding exactly to the locations of the inputs to a linear array of radiators, and (d) to permit, in some circumstances, the elimination of an array of discrete radiators in favour of direct radiation from the linear aperture formed by the last parallel plate petal element of the lens. (In this last instance, the linear aperture may be flared to control the beam pattern in the plane normal to the plane of the parallel plates.) Given the constraints for the required lens structure, and selecting the number of individual "petal" elements, the shapes of the edges of the petal elements (including, if necessary, the initial input and final output edges) can be computed for a required aberration limit.

This approach, which is also applicable to those lens structures, described later in this specification, in which no reflection process is involved in transmitting the signal from one lens petal to the next, can be implemented conveniently by treating the lens as a multi-reflector collimator. The various desired parameters of the lens are defined and an edge shape for each petal element is selected; then, rays are traced back from the output of the lens to their focal point at the input of the lens and an indication of aberration is obtained. This indication might be, for example, the deviation of this focal point from the desired input point. By repeating this procedure for many points on the output of the lens, and for many input angles, an index of performance of the lens (such as the RMS value of the errors noted), which is a measure of its aberration, can be obtained. Those skilled in this art will appreciate that other techniques for determining an indication of the overall lens aberration may be used.

The edge shapes of the petals are then altered and the ray tracing (or alternative) exercise is repeated. By an iterative process, the best edge shapes near those originally selected, that is, the edge shapes producing the best performance index, are determined. If this minimum performance index is equivalent to an aberration which is too great for the aerial, the process is repeated using different starting edge shapes.

Using this approach, a petal lens structure having an inherent aberration which is less than that of the flattened-petal approximation to a quarter-sphere lens can be obtained.

If only two reflecting surfaces between the input and output edges of the lens are chosen, and a true reflecting embodiment of the present invention is constructed (i.e., the signal is coupled from one lens element to the next by a reflecting process), it is possible that an aerial structure similar to the known "bifocal pill-box" aerial will be designed. Bifocal aerials have been described, for example, by B. L. J. Rao, in his paper entitled "Bifocal Dual Reflector Antenna" which appeared in IEEE Transactions on Antennas and Propagation, September, 1974, pages 711–714; by H. Kumazawa and M. Karikomi in the November 1973 issue of the same journal, at pages 876–877, in their paper entitled "Multiple-beam antenna for domestic communication satellites"; and by B. Claydon, in his two papers in The Marconi Review, First and Second Quarters, 1975, respectively. The bifocal aerials are constructed so that two off-axis beams received by the aerial are perfectly focussed by it. That type of aerial has been designed for a purpose different from the present invention, by a technique which cannot be extended beyond the two-reflector case (except in the trivial situation where additional plane reflectors are used to increase the ratio of focal length to aerial aperture without producing a massive structure). The bifocal aerials, with or without plane reflectors, are specifically disclaimed as not being within the scope of the present invention.

Thus, according to the present invention, a parallel plate electromagnetic lens comprises a plurality of petal-shaped parallel plate lens sections or elements connected in series, each petal-shaped section having a signal inlet edge and a signal output edge, signal input means being provided along each inlet edge for supplying RF signals to the associated lens section or element, and signal outlet means being provided along each output edge for conducting signals out of the associated lens section or element.

The series interconnection of the individual petals may be effected by RF connections between the signal outlet means of one petal and the signal inlet means of the adjacent petal in the form of RF cables joining respective probes arranged in arrays along the perimeters of individual petals. If the petals are stacked as described later in this specification, the interconnection means may be in the form of low-reflection bends, or slots.

To better understand the present invention, a description of some "petal lens" aerials derived using both approaches outlined above, and some of the associated mathematical reasoning, will now be given, with reference to the accompanying drawings, in which.

Figure 1:
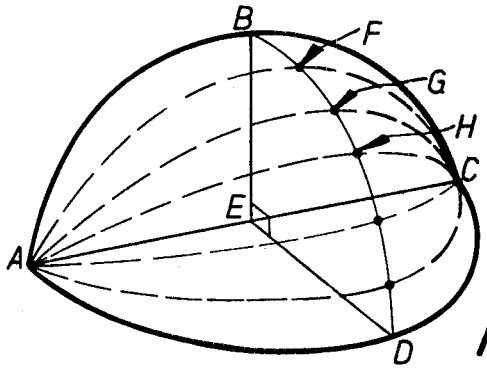
FIG. 1 is a perspective sketch of the quarter-sphere geodesic lens structure, with individual petal elements indicated thereon.

Referring to FIG. 1, ABCDA is the outline of a quarter-sphere parallel plate geodesic lens of the type described in the specification of aforementioned U.S. Pat. No. 4,114,162. The curved edge ABC of this lens is adapted, at intervals, to be connected to or to contain an array of microwave excitation elements (for example, probes). The other curved edge ADC is connected via equal length RF cables to a linear array of radiating elements. BED is the plane of symmetry of the geodesic lens. Great circle lines AFC, AGC, and so on, divide the quarter-sphere into a number of parallel plate petals. In principle, each individual petal may be separated and re-connected, as shown in FIG. 2, by providing reflectionless probes in each curved edge.

Figure 2:
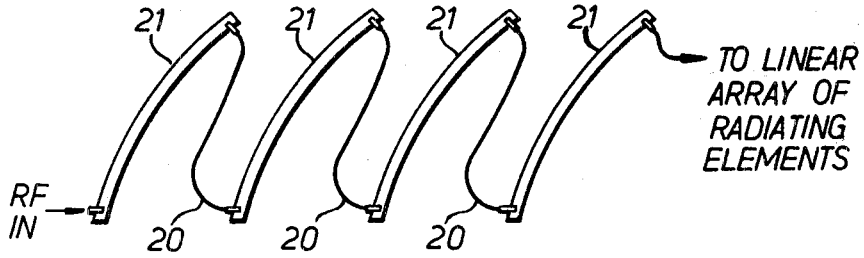
FIG. 2 is a sectional view of a compound petal lens structure derived from the lens of FIG. 1.

The embodiment of FIG. 2 is the basic form of the present invention. It yields a lens structure which occupies only a fraction of the space of a quarter-sphere parallel plate structure. The actual size of the petal lens having this configuration will depend on the number of segments or petals 21 in the lens.

Figure 3:
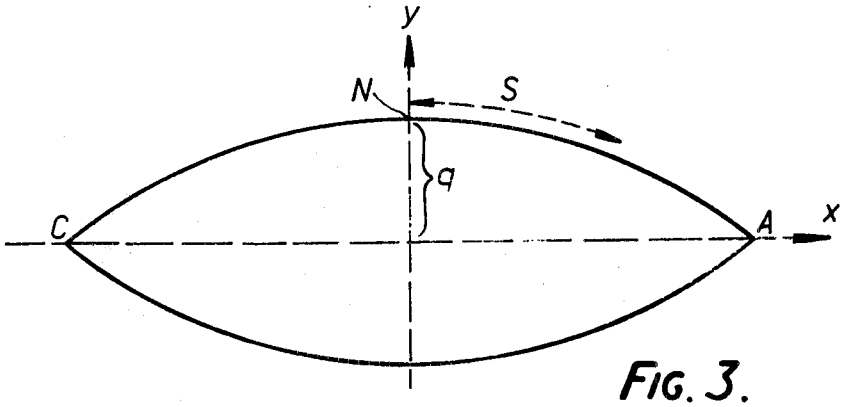
FIG. 3 represents a flat parallel plate petal-shaped lens element corresponding to a segment of the lens structure of FIG. 1.

As already noted, the individual segments 21 of the embodiment of FIG. 2 can conveniently be replaced with equivalent flat, petal-shaped, parallel plate structures, such as those shown in FIG. 3.

If the petal shape depicted in FIG. 3 is ideal, it can be defined by the relationship (using the nomenclature of FIG. 3)

$$y = q \cos s$$

where $$q = \sin(\pi/4n)$$

and $$ds^2 = dx^2 + dy^2.$$

This expression for y represents the flattened cylindrical petal between two lines of longitude of a sphere. It can be expressed in Cartesian coordinates (x, y) in the form:

$$dx = \left( \frac{1}{q^2 \sin^2 s} - 1 \right)$$
$$= \frac{(1 - t^2)^{\frac{1}{2}}}{t} \cdot dy$$

where $$t = (q^2 - y^2)^{\frac{1}{2}}.$$

This relationship can be re-written, using a power series expansion, as:

$$dx = \left\{ \frac{1}{t} - \tfrac{1}{2} \cdot t - \tfrac{1}{8} \cdot t^3 - \frac{1}{16} \cdot t^5 - \ldots \right\} dy.$$

Thus $$x = \int_y^q \left\{ \frac{1}{t} - \tfrac{1}{2} \cdot t - \tfrac{1}{8} \cdot t^3 - \frac{1}{16} \cdot t^5 - \ldots \right\} dy.$$

After integration, $$x = \cos^{-1}\left(\frac{y}{q}\right)\left(1 - \frac{q^2}{4} - \frac{3q^4}{64}\right) + \frac{y \ldots t}{4} + \frac{yt^3}{32} + \frac{3q^2 \cdot y \cdot t}{64},$$

provided all sixth order terms are neglected (which is acceptable if the number of petals is 4 or more, and is even marginally acceptable if 2 petals only are included in the compound lens).

Figure 4A:
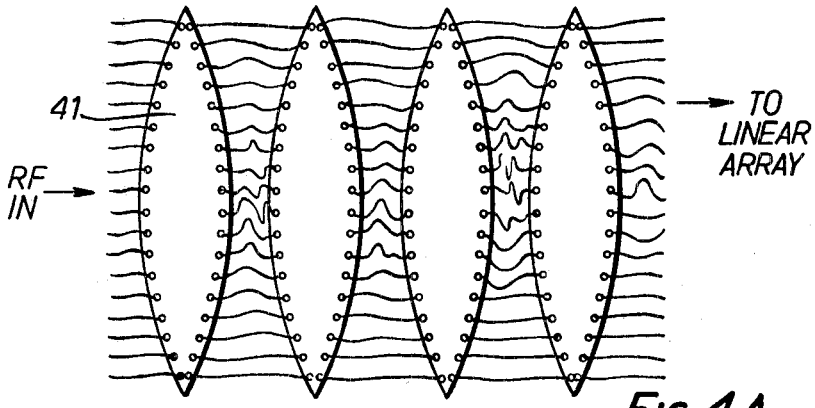
FIGS. 4A and 4B show, schematically, two embodiments of the new lens structure.

Using such flat parallel plate "petals", a flat lens having the structure illustrated in FIG. 4A may be produced, with the input (and output) probes spaced about $\lambda/2$ apart ($\lambda$ is one wavelength of the RF signals being transmitted through the lens).

Figure 4B:
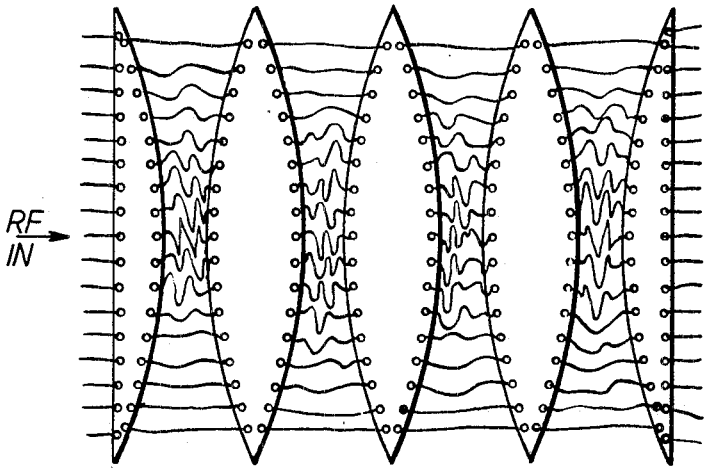

The lens structure shown in FIG. 4B is similar to that of FIG. 4A, but has "half-petals" as the first and last parallel plate elements of the lens. A "half-petal"—or, more accurately, a petal having a straight edge—used to receive RF power from the commutated supply to the lens has the advantage that input probes in a straight line cannot exhibit self-illumination because the probes have zero radiation along that line. Self-illumination occurs when radiation from one input probe travels in such a direction within the parallel plate that it is incident upon another input probe. Deterioration of lens performance may be experienced if self-illumination occurs, and this is a real possibility with the outermost input probes of petal 41 of the lens structure of FIG. 4A. In fact, if required, the input edge of the first petal of a lens of the present invention may be convex, to provide for a convex arc of input probes, which cannot exhibit self-illumination.

A straight line array of output probes in the final petal of the lens structure of FIG. 4B simplifies the RF connection to a linear array of radiators (not shown).

Figure 5:
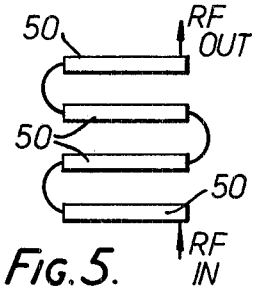
FIG. 5 illustrates, schematically, one way in which the petal elements may be stacked to form a compact electromagnetic lens structure.

It should be clear to those skilled in the art that the individual petal-shaped parallel plate elements of the present invention can be stacked to produce a compact petal lens structure. FIG. 5 illustrates symbolically the principle of stacking individual petal elements 50. While the petal elements may, in fact, be stacked as shown in FIG. 5, other ways of interconnecting the individual petals are possible.

Figure 6:
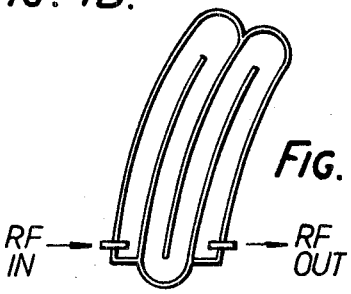
FIGS. 6 and 7 are sectional representations of ways in which a compact petal lens may be constructed.

FIG. 6 illustrates one way in which the composite lens structure of FIG. 2 may be made more compact, with even-number petals effectively turned inside out and their edges aligned with odd number petals, the interconnection between petals being by 180° curved parallel plate sections formed integrally with the petals.

Figure 7:
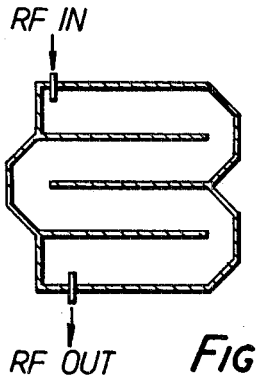

FIG. 7 shows a similar stacking with flat petals, the continuous reflectionless path between adjacent petals being provided with mitred parallel plate corners.

Figure 8A:
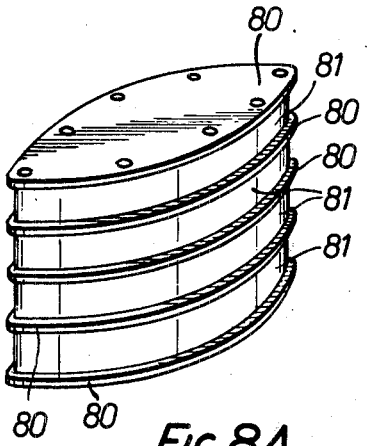
FIGS. 8A and 8B illustrate (in perspective and part-sectional views) the construction of one form of compact petal lens.
Figure 8B:
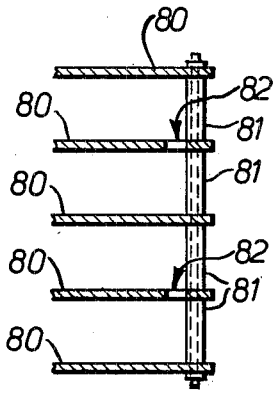

FIGS. 8A and 8B show how a plurality of petal-shaped flat plates 80 may be secured through curved side-walls 81 to provide a compact petal lens with interconnections between the individual parallel plate petals being provided by arrays of slots or apertures 82 adjacent to the effective edges of the petals, or by back-to-back symmetrical probes in the same locations.

Figure 9:
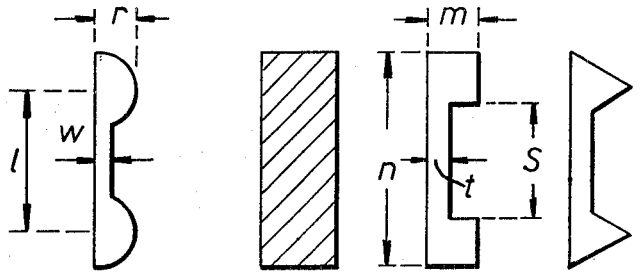
FIG. 9 depicts several shapes of slot coupling apertures that may be used to interconnect the "petals" of the lens having a construction of the form illustrated in FIGS. 8A and 8B.

If apertures 82 provide the coupling between the petals of a lens constructed in accordance with the arrangement of FIG. 8, they comprise a single row of slots, located parallel to the wall 81, with the individual slots in the row having a centre-to-centre spacing of $\lambda/2$ or less at the centre frequency of the antenna which includes the lens. Any suitably shaped loaded slot having a length less than $\lambda/2$ can be used to effect the coupling. Examples of suitable shapes are given in FIG. 9. Of these illustrated shapes, the second is a rectangular slot, loaded with a dielectric. To provide coupling of RF power at a frequency of 5.06 GHz, the dimensions shown for two of the slot shapes illustrated in FIG. 9 are:

(a)

l=18.20 mm.
w=3.15 mm.
r=3.70 mm.

(b)

s=10.80 mm.
t=2.60 mm.
m=6.50 mm.
n=21.70 mm.

The preferred slot shape, chosen for use in an experimental lens constructed to test the present inventive concept, is the half-dumbell shape of the first (left end) illustration in FIG. 9. This shape is preferred because each slot can be constructed readily by forming a complete dumbell shape in a plate 80 with the centres of the circular ends of the dumbell on the line of the inner edge of wall 81, and bisecting the dumbell slot with the respective wall 81 when the lens is assembled. This allows for means for fine mechanical adjustment of the position of walls 81 to be included in the lens to control the coupling. It has also been found that the half of the dumbell which is covered by the wall 81 forms a cavity which favourably affects the resonance of the slot and lessens the criticality of the dimension w (see FIG. 9) of the coupling slot.

From experimental observations, it has been noted that the usefulness of the cavity remains even when the thickness of plate 80 is comparable to the dimension w.

It should be noted that although lens structures having four "petals" have been illustrated in FIGS. 2, 4A, 5, 6, 7 and 8A and 8B, the present invention is by no means limited to "four-petal" lens structures. Depending on the use to which the aerial incorporating the lens structure is to be put, any plurality of petals can be used, the maximum number being limited by practical considerations only.

It should also be noted that, as pointed out earlier in this specification, other shapes of petals can be used, the shapes being driven by, for example, the multi-reflector beam analysis technique. One way in which this approach works can be explained with reference to FIG. 10, which illustrates a ray tracing technique with two reflectors. The two reflectors 90, 91, having shapes $y_1(x)$ and $y_2(x)$, respectively, are located between a linear input feed array 92 and a linear output 93. The phase front 94 of a beam transmitted at an angle $\theta$ to the central beam of the aerial structure is established at the output 93. One ray contributing to the wavefront is traced from the output 93, via reflector 90 (where it is reflected at the point $(x_1,y_1)$) and reflector 91 (at point $(x_2,y_2)$) to the input, where it will be focussed at the point $x_h$. Ideally, this ray should have been focussed at the point $(x_o,y_o)$. The distance, h, between the actual focus and the desired focus is a measure of the error in focussing.

The ray trace may be repeated for many points on the output 93, and for many angles $\theta$. The RMS value of the error, h, is then calculated, to provide a measure of the overall aberration of the composite lens.

By repeating this process with different reflector shapes $y_1(x)$ and $y_2(x)$, an iterative process can be developed to find reflector shapes which minimise the RMS aberration for any given initial petal geometry. These shapes can then be used as the edge shapes for the parallel plate petals.

An alternative to this technique is to consider path length errors between input points and the output plane, rather than focussing error.

Figure 10:
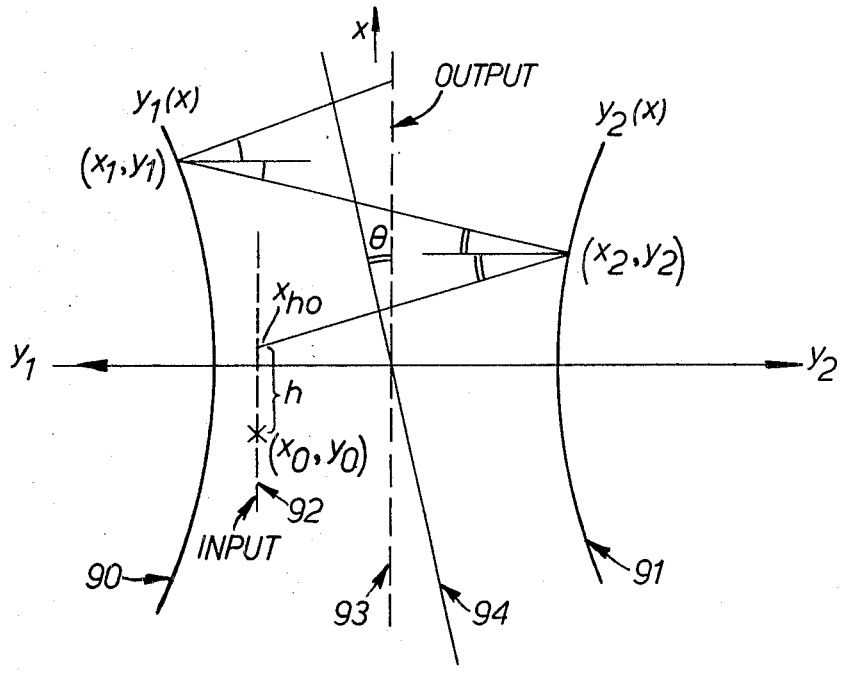
FIG. 10 is a schematic diagram of a two-reflector lens structure with linear input and output edges, showing the derivation of optimised lens shapes.

To design a practical petal-lens antenna, the focusing-error technique illustrated in FIG. 10 was applied to a three reflector situation. The starting reflector shapes were:

$$y_1(x)=y_2(x)=y_3(x)=0.1870-0.1793x^2+0.02241x^4.$$

Figure 11A:
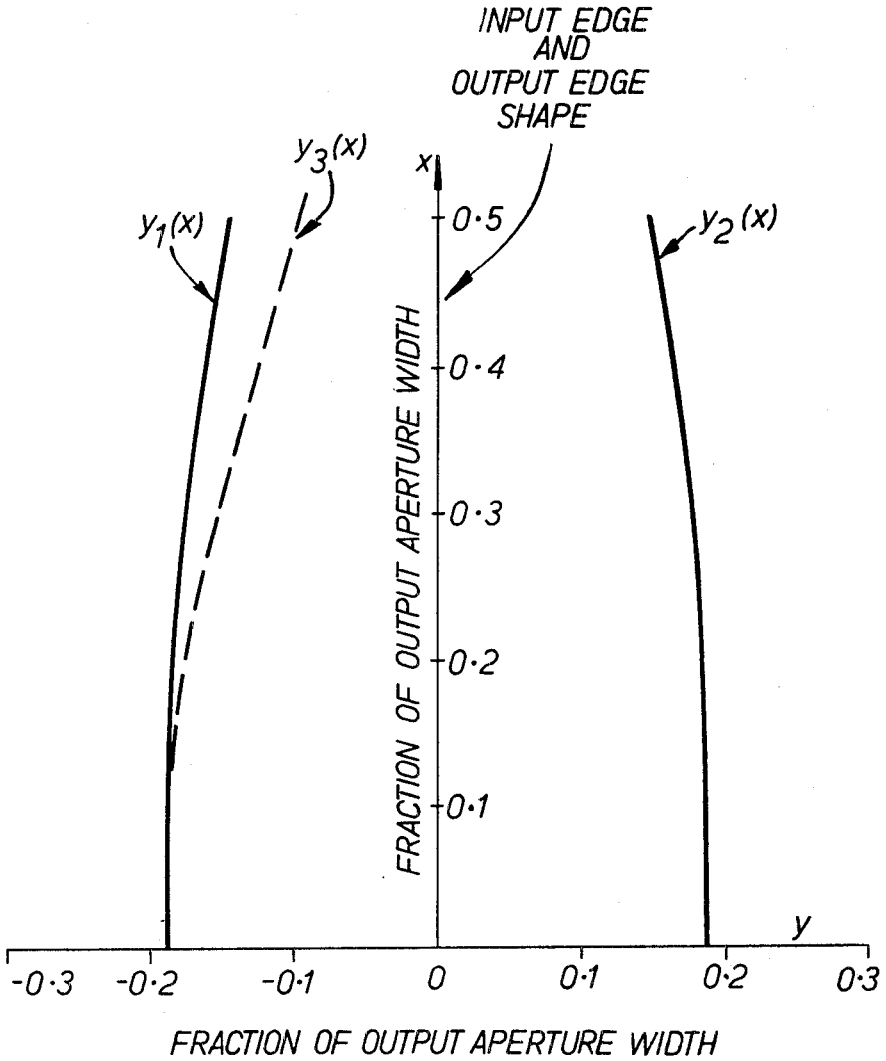
FIGS. 11*a* and 11*b* illustrate edge shapes calculated for two different designs of parallel plate lens structure, each incorporating three reflections.
Figure 11B:
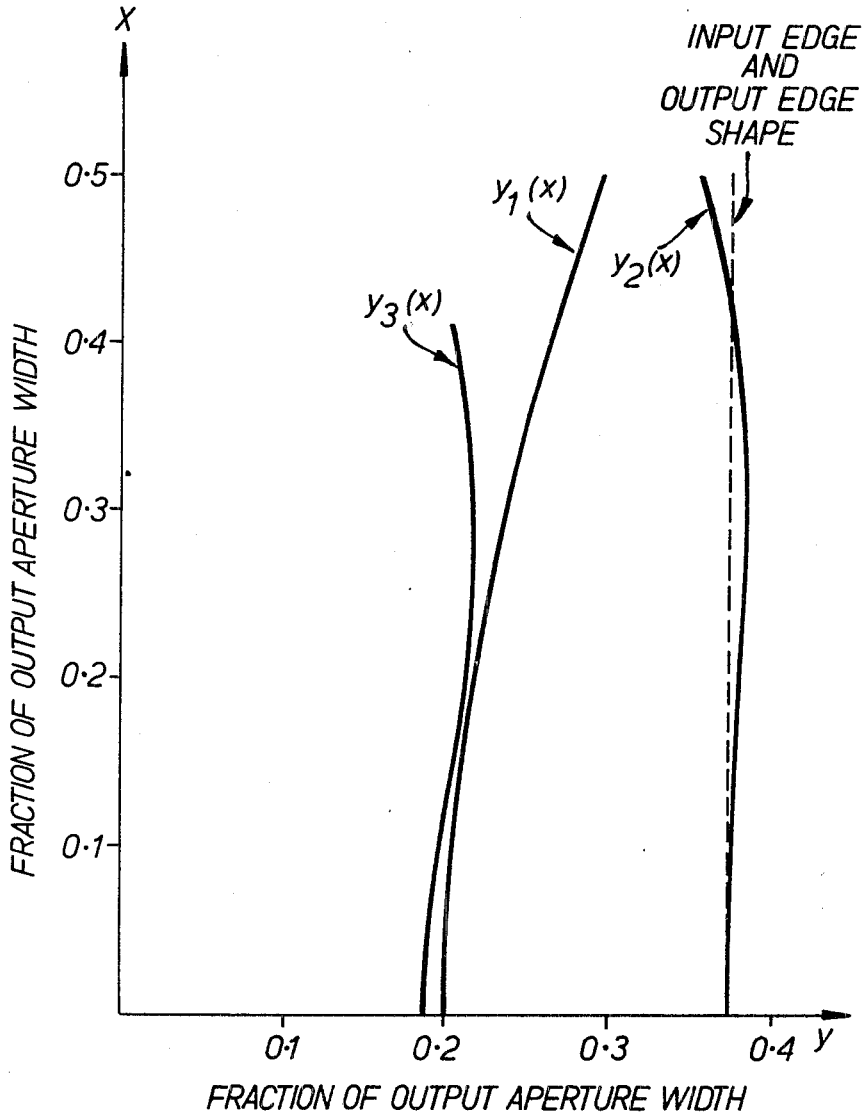

The optimised reflector shapes illustrated in FIG. 11A were derived. Similarly, from reflectors with:

$$y_1(x)=-0.2006-0.1725x^2-1.026x^4+3.3439x^6,$$

$$y_2(x)=0.3756-0.0770x^2-0.0355x^4-1.5865x^6, \text{ and}$$

$$y_3(x)=-0.187,$$

the optimised reflector shapes of FIG. 11B were obtained. In the case of the reflector shapes derived in FIG. 11A, the linear input length and linear output length of the lens were equal. In FIG. 11B, the linear input length was two-thirds that of the linear output length.

In another example, a three-reflector lens was designed with a convex input arc having the shape:

$$y_{ix}=0.2866+0.157x^2$$

The starting reflector shapes were:

$$y_1(x)=-0.0328+0.1072x^2,$$

$$y_2(x)=0.3-0.1078x^2,$$

$$y_3(x)=-0.0328+0.3878x^2.$$

The optimised reflector shapes were:

$$y_1(x)=-0.0328+0.2912x^2-0.07399x^4,$$

$$y_2(x)=0.3+0.2837x^2-0.3099x^4,$$

$$y_3(x)=-0.0328+0.5235x^2+0.07015x^4.$$

The above examples illustrate only lenses, such as the lenses depicted in FIGS. 7, 8A and 8B where the output edge of a petal is the same shape as the input edge of the next succeeding petal. In the more general case where the input and output edges of the petals are not the same shape, they are better interconnected by cables, as shown in FIGS. 4 and 5.

As already mentioned, an experimental lens was constructed to test the present inventive concept. This was a two-reflector lens having a slightly convex input arc and a directly radiating (i.e. linear) output arc. It was built using the construction form illustrated in FIGS. 8A and 8B, and it included means to permit the fine mechanical adjustment of the position of the walls of the lens (equivalent to the walls 81 of FIGS. 8A and 8B) relative to the coupling slots. The lens was provided with 12 input probes, which were not equally spaced around the input arc. The slots coupling the "petals" of the lens were half-dumbell slots in the plates of the lens by the technique described above. Using this lens, an antenna was constructed to scan a radio beam having a frequency of 5.06 GHz over a coverage zone of ±12°. The pointing error of this antenna, expressed as two standard deviations of a series of measurements, was found to be less than 0.06°.

We claim:

1. A parallel plate electromagnetic lens comprising a plurality of petal-shaped parallel plate lens sections or elements connected in series, each petal-shaped section having a signal inlet edge and a signal output edge, signal input means being provided along each inlet edge for supplying RF signals to the associated lens section or element, and signal outlet means being provided along each output edge for conducting signals out of the associated lens section or element.

2. A parallel plate lens as defined in claim 1, in which the signal input means is an array of input probes, the signal outlet means is an array of output probes, and the series interconnection of the petals is effected by RF cables connecting each output probe with its associated input probe of the adjacent petal.

3. A parallel plate lens as defined in claim 1, in which the petal-shaped lens sections are similarly shaped and are stacked so that the output edge of one petal is located adjacent to the inlet edge of the next succeeding petal of the lens.

4. A parallel plate lens as defined in claim 3, in which the series interconnection of the petals is effected by low-reflection parallel plate bends.

5. A parallel plate lens as defined in claim 3, in which the plates are formed by conducting plates which are spaced apart by conducting walls, said walls defining the edge shapes of the petals, and in which the series interconnection of the petals is effected by arrays of apertures in the conducting plates, the apertures being located adjacent to the effective edges of the petals.

6. A parallel plate lens as defined in claim 5, in which the arrays of apertures comprise rows of loaded slots, the centres of the slots being spaced apart a distance not exceeding the half-wavelength of the central operating frequency of the lens.

7. A parallel plate lens as defined in claim 6, in which each slot has the shape of a half-dumbell and is formed by the bisection of a slot having the shape of a full dumbell by its associated conducting walls.

8. A parallel plate lens as defined in claim 1, in which the petals are segments of a quarter-sphere parallel plate lens.

9. A parallel plate lens as defined in claim 1, in which the petals are flat equivalents of segments of a quarter-sphere parallel plate lens.

10. A parallel plate lens as defined in claim 1, in which the signal outlet means of the last petal of the lens comprises an array of output probes, each probe of which is connected by an associated RF cable to a respective radiator of a linear array of microwave radiators.

11. A parallel plate lens as defined in claim 1, in which the signal output edge of the last petal of the lens is linear.

12. A parallel plate lens as defined in claim 11, in which the linear signal output edge of the last petal of the lens is connected directly to a linear array of microwave radiators.

13. A parallel plate lens as defined in claim 11, in which the linear signal outlet edge of the last petal of the lens forms a radiating aperture.

14. A parallel plate lens as defined in claim 13, in which the radiating aperture is flared.

15. A parallel plate lens as defined in claim 1, in which the shape of each signal inlet edge and each signal output edge is determined by choosing required parameters for the lens and performing the steps of (a) selecting first edge shapes;

(b) using ray tracing techniques and working from the output of the lens, determining the focal points at the input of the lens for a plurality of output points and output angles;

(c) deriving, from the focal point determinations of step (b), an indication of the overall lens aberration;

(d) altering the selected first edge shapes;

(e) repeating steps (b) and (c) to obtain a further indication of the overall lens aberration;

(f) repeating steps (d) and (e) a sufficient number of times to obtain a minimum or acceptable overall lens aberration; and (g) adopting the edge shapes which give the minimum or acceptable overall lens aberration as the edge shapes for the lens.

16. A parallel plate lens as defined in claim 15, in which the indication of the overall lens aberration is the RMS value of the distances between the measured focal points and the required focal points.

17. A scanning beam antenna comprising a parallel plate lens as defined in claim 1, in which the output of an RF transmitter is commutatively connected to an array of input probes comprising the signal input means of the first petal of the lens.

* * * * *